US007921591B1

(12) United States Patent
Adcock

(10) Patent No.: US 7,921,591 B1
(45) Date of Patent: Apr. 12, 2011

(54) FLIP-UP AIMING SIGHT

(76) Inventor: Terry Adcock, Bethesda, MD (US)

( * ) Notice: Subject to any disclaimer, the term of this patent is extended or adjusted under 35 U.S.C. 154(b) by 176 days.

(21) Appl. No.: 12/387,303

(22) Filed: Apr. 30, 2009

(51) Int. Cl.
*F41G 1/00* (2006.01)

(52) U.S. Cl. ..... 42/113; 42/145; 42/111

(58) Field of Classification Search ..... 42/145, 42/113, 111, 90
See application file for complete search history.

(56) References Cited

U.S. PATENT DOCUMENTS

| | | | | | |
|---|---|---|---|---|---|
| 561,360 | A | * | 6/1896 | Taylor | 42/140 |
| 805,770 | A | * | 11/1905 | Bassell | 42/140 |
| 878,857 | A | * | 2/1908 | Bevier | 42/136 |
| 1,260,545 | A | * | 3/1918 | Jackson | 42/140 |
| 1,428,115 | A | * | 9/1922 | Perrin | 42/122 |
| 1,602,116 | A | * | 10/1926 | Manahan et al. | 42/125 |
| 1,964,027 | A | * | 6/1934 | Bliss | 42/141 |
| 2,032,648 | A | * | 3/1936 | Bliss | 42/136 |
| 2,187,057 | A | * | 1/1940 | Sauer | 396/386 |
| 2,276,446 | A | * | 3/1942 | Zimmerman | 42/140 |
| 2,498,706 | A | * | 2/1950 | Pease et al. | 42/111 |
| 2,596,522 | A | * | 5/1952 | Bethke | 42/113 |
| 2,615,252 | A | * | 10/1952 | Wing | 42/144 |
| 2,633,051 | A | * | 3/1953 | Davis | 356/251 |
| 2,780,130 | A | * | 2/1957 | Mauer | 356/251 |
| 3,098,303 | A | * | 7/1963 | Plisk | 42/145 |
| 3,641,676 | A | * | 2/1972 | Knutsen et al. | 42/136 |
| 3,700,339 | A | * | 10/1972 | Steck, III | 356/247 |
| 3,813,790 | A | * | 6/1974 | Kaltmann | 42/132 |
| 3,824,699 | A | * | 7/1974 | Lenz et al. | 33/334 |
| 3,833,799 | A | * | 9/1974 | Audet | 42/132 |
| 3,861,803 | A | * | 1/1975 | Sallans | 356/254 |
| 3,942,901 | A | * | 3/1976 | Ekstrand | 356/251 |
| 3,963,356 | A | * | 6/1976 | Wiklund | 356/251 |
| 3,992,782 | A | * | 11/1976 | Rickert | 42/120 |
| 3,994,597 | A | * | 11/1976 | Calder et al. | 356/251 |
| 4,068,926 | A | * | 1/1978 | Nakamura et al. | 349/97 |
| 4,070,763 | A | * | 1/1978 | Carts, Jr. | 42/132 |
| 4,117,265 | A | * | 9/1978 | Gerlach | 704/277 |
| 4,136,963 | A | * | 1/1979 | Budden et al. | 356/251 |
| 4,313,272 | A | * | 2/1982 | Matthews | 42/115 |
| 4,313,273 | A | * | 2/1982 | Matthews et al. | 42/117 |
| 4,375,725 | A | * | 3/1983 | Orlob | 42/119 |
| 4,402,605 | A | * | 9/1983 | Ekstrand | 356/252 |
| 4,458,436 | A | * | 7/1984 | Bohl | 42/133 |
| 4,488,369 | A | * | 12/1984 | Van Note | 42/1.01 |
| 4,665,622 | A | * | 5/1987 | Idan | 42/113 |
| 4,725,235 | A | * | 2/1988 | Schroeder et al. | 434/18 |
| 4,734,989 | A | * | 4/1988 | Sanders | 42/137 |
| 4,734,990 | A | * | 4/1988 | Sanders | 42/137 |
| 4,776,126 | A | * | 10/1988 | Williams | 42/125 |
| 4,850,113 | A | * | 7/1989 | Doll | 42/130 |

(Continued)

FOREIGN PATENT DOCUMENTS

DE 4214997 A1 * 11/1993

(Continued)

*Primary Examiner* — Michael Carone
*Assistant Examiner* — Richard L Norman
(74) *Attorney, Agent, or Firm* — John P. McGonagle

(57) ABSTRACT

An aiming system having a two-tone colored rear sight lens as the primary aiming component. The lens is held in an L-shaped lens frame which also incorporated conventional "iron sights." The two-tone colored lens has an outside perimeter portion of one color and a central portion of another color. The lens frame can fold or rotate forward from an upright locked position to a locked-down position using a manually activated one-handed operation.

10 Claims, 5 Drawing Sheets

U.S. PATENT DOCUMENTS 4,877,324 A * 10/1989 Hauri et al. ..... 356/251
4,912,852 A * 4/1990 Sanders ..... 42/131
4,918,823 A * 4/1990 Santiago ..... 42/132
4,993,833 A * 2/1991 Lorey et al. ..... 356/252
5,052,790 A * 10/1991 Edwards et al. ..... 359/399
5,148,603 A * 9/1992 Beutler ..... 33/265
5,243,448 A * 9/1993 Banbury ..... 359/13
5,369,888 A * 12/1994 Kay et al. ..... 42/113
5,533,292 A * 7/1996 Swan ..... 42/123
5,577,326 A * 11/1996 Montelin ..... 42/113
5,594,584 A * 1/1997 Kay et al. ..... 359/433
5,813,159 A * 9/1998 Kay et al. ..... 42/113
5,822,872 A * 10/1998 Waki ..... 42/111
5,878,521 A * 3/1999 Warnock ..... 42/145
5,901,452 A * 5/1999 Clarkson ..... 42/131
5,992,030 A * 11/1999 Mann ..... 42/144
6,233,836 B1 * 5/2001 Uhlmann et al. ..... 42/145
6,289,625 B1 * 9/2001 Phares ..... 42/119
6,321,479 B1 * 11/2001 Sheehan ..... 42/111
6,604,315 B1 * 8/2003 Smith et al. ..... 42/112
6,732,467 B1 * 5/2004 Luth ..... 42/138
6,871,439 B1 * 3/2005 Edwards ..... 42/84
6,879,782 B2 * 4/2005 Nakano et al. ..... 396/535
6,952,295 B2 * 10/2005 Suzuki et al. ..... 359/15
6,984,046 B2 * 1/2006 Abe et al. ..... 359/457
7,069,685 B2 * 7/2006 Houde-Walter ..... 42/132
D526,380 S * 8/2006 Swan ..... D22/109
7,171,776 B2 * 2/2007 Staley, III ..... 42/142
7,225,578 B2 * 6/2007 Tai ..... 42/132
7,325,354 B2 * 2/2008 Grauslys et al. ..... 42/131
7,356,962 B2 * 4/2008 Swan ..... 42/147
7,543,361 B2 * 6/2009 Borchardt et al. ..... 24/399
7,562,486 B2 * 7/2009 LoRocco ..... 42/132
7,685,760 B1 * 3/2010 Neumaster ..... 42/129
7,739,825 B2 * 6/2010 LoRocco ..... 42/132
2002/0036617 A1 * 3/2002 Pryor ..... 345/156
2002/0056220 A1 * 5/2002 Hoadley ..... 42/111
2002/0137571 A1 * 9/2002 McMahon ..... 473/210
2002/0159111 A1 * 10/2002 Suzuki et al. ..... 359/32
2002/0163486 A1 * 11/2002 Ronzani et al. ..... 345/87
2002/0175614 A1 * 11/2002 Sakata et al. ..... 313/463
2003/0009925 A1 * 1/2003 Schoemaker et al. ..... 42/113
2003/0017856 A1 * 1/2003 Kotchick et al. ..... 455/566
2003/0185554 A1 * 10/2003 Nakano et al. ..... 396/235
2004/0165060 A1 * 8/2004 McNelley et al. ..... 348/14.08
2004/0169617 A1 * 9/2004 Yelton et al. ..... 345/1.1
2004/0169663 A1 * 9/2004 Bernier ..... 345/629
2005/0057808 A1 * 3/2005 Houde-Walter ..... 359/566
2005/0125119 A1 * 6/2005 Srack et al. ..... 701/33
2005/0241209 A1 * 11/2005 Staley, III ..... 42/111
2005/0259845 A1 * 11/2005 Dehlin et al. ..... 382/103
2005/0268519 A1 * 12/2005 Pikielny ..... 42/124
2006/0029271 A1 * 2/2006 Miyoshi et al. ..... 382/154
2006/0039066 A1 * 2/2006 Abe et al. ..... 359/457
2006/0048432 A1 * 3/2006 Staley, III ..... 42/122
2007/0124982 A1 * 6/2007 Cheng et al. ..... 42/113
2007/0214699 A1 * 9/2007 Sne et al. ..... 42/111
2007/0240354 A1 * 10/2007 Warren ..... 42/111
2008/0034637 A1 * 2/2008 Summers ..... 42/111
2008/0134561 A1 * 6/2008 Clouser ..... 42/113
2008/0184609 A1 * 8/2008 Schulst ..... 42/111
2009/0013581 A1 * 1/2009 LoRocco ..... 42/132
2009/0019758 A1 * 1/2009 Baugher ..... 42/111
2010/0281749 A1 * 11/2010 Stenton et al. ..... 42/111

FOREIGN PATENT DOCUMENTS

EP 470016 A1 * 2/1992
FR 2572802 A1 * 5/1986

* cited by examiner

FLIP-UP AIMING SIGHT

BACKGROUND OF THE INVENTION

The present invention relates generally to the field of firearm sighting devices, and in particular to a flip-up aiming sight having a two-toned colored lens as the primary aiming component.

Traditional open sights use a static mechanical (non-electrical) configuration to aid a shooter in acquiring a correct sight picture. A sight picture is the orientation of a gun sight to a target. A correct sight picture combines sight alignment with the point of aim. Traditional open sights are comprised of an open, unmagnified system used to assist in aiming a firearm. The classic, traditional open sight system is comprised of a rear sight mounted vertically transverse to the line of sight, said rear sight consisting of some form of notch or aperture. The classic open sight is further comprised of front sight comprised of a post, bead or ring. On many firearms, the rear sight is adjustable for windage and/or elevation. When aiming, the front sight is brought to the central part of the notch or aperture, preferably the middle, for lateral aiming, and at the same height as the rear sight for vertical aiming.

Open sights are often enhanced for low-light situations with a three-dot system. A distinctive white dot (or other colors if preferred) is added to the front sight and on either side of the rear sight notch. When properly aimed, the sight picture appears as three white dots aligned on a horizontal plane.

The main limitation with traditional open sights is the difficulty the human eye has in focusing simultaneously on three separate objects, i.e., rear sight, front sight, and target. It is difficult to align the front post in the center of the notch with equal distance on either side of the front post, while simultaneously aligning the top of the front post level with the top of the rear notch sight. From a strictly physiological standpoint, the human eye cannot focus simultaneously on more than one object at a time. Due to the juxtaposition of the weapon being closer to the eye than the target, the eye will focus either on the rear sight making the front sight and the target a blur, or on the front sight making the rear sight and the target a blur, or on the target making the two gun sights a blur.

Compounding the sighting problem with open sights are two conditions known as "sympathetic nervous system" (SNS) and parasympathetic nervous system" (PNS). SNS is the involuntary reflective response that the human body experiences when the brain perceives either a life-threatening situation or a person is suddenly startled. This is an involuntary physiological response to external stimuli. SNS is also known as the "fight or flight" reflex. Under SNS the body does a "mass discharge" of hormones that helps prepare the body to defend or flee (fight or flight response). The immediate physical changes the body undergoes is simply the body preparing to defend itself from a threat or to take flight and avoid the threat if possible. The mass discharge of hormones includes an increase in arterial pressure and blood flow to the large muscle groups (to enhance gross motor skills and strength), vasoconstriction of minor blood vessels in the extremities, pupil dilation, cessation of the digestive process, and muscle tremors. Once the threat is eliminated, the body returns to its normal state, which is governed by the parasympathetic nervous system. PNS is normally in control of the body in the absence of any threat stimulus, i.e., a non-stressful environment. Fine and complex motor skills are exhibited; full peripheral vision is possible; and heart rate and blood are at their normal state. Gross motor skills are those actions by large or major muscle groups involving strength and simple symmetrical movements such as punching, swinging a club, kicking a ball, etc. Fine motor skills employ hand/eye coordination and hand dexterity such as aiming/firing a weapon, working with tools, typing on a keyboard, etc. Complex motor skills make use of a series of muscle groups that require hand/eye coordination, precision movements, tracking and timing. In shooting, complex motor skills require a series of movements and muscle groups to focus on the target while sighting the weapon.

SNS impacts the brain in the areas of motor skills, sensing perception (in particular, impaired vision), and mental processes. With respect to vision impairment, there are three areas that are affected: reduced peripheral vision, distance-only eyesight, and forced binocular vision. Reduced peripheral vision is caused by restricted blood flow to the eyes and muscle contractions. The eye lens tends to flatten, thus reducing depth perception resulting in the effect known as "tunnel vision." SNS causes the body and eyes to focus on the source of a threat and ignore near objects. Near objects are almost impossible to discern resulting in distance-only eyesight. Forced binocular vision is caused by the body naturally squaring off to face a threat. Eyes open wide to admit as much light as possible to help the body discern the nature of the threat and how to react to it Shooters who are familiar with or professionally trained in handling firearms know it is difficult to place shots consistently and accurately on target under stress-free or controlled, non-threatening situations, e.g., target practice. However, when the brain perceives a life-threatening situation and SNS activates within the body, the physical effects of the "mass release" of hormones directly impact the shooter's ability to deliberately focus on the target and fire the weapon.

In conducting tests of trained police officers, Burroughs (1997) found that 59% reported not actually "seeing" or using their sights that involved high stress (SNS) scenarios, but focused almost exclusively on the threat/target itself. Additional studies have shown that the effects of SNS impairs hearing (auditory exclusion) and peripheral vision (tunnel vision).

That trained officers, when confronting life-threatening situations, revert to the basic instincts of "fight or flight" further strengthens the argument that traditional gun sights are marginally functional in those situations. Therefore, there remains the need for a simple, reflexive gun sight that takes advantage of a human's instinctive reactions, such as forced binocular vision, where the shooter is focused solely on the threat/target. It is also desirable, to provide an aiming system that facilitates the ease, speed and accuracy with which a shooter aligns his weapon on a target thereby meeting the need to get on target fast and accurately.

The present invention proposes a color-activated gun sight (as opposed to geometrically aligned gun sights) to meet this need. The present invention will aid the shooter in acquiring a correct sight picture and accurate shot placement even in high stress situations without taking one's eyes off the threat itself.

SUMMARY OF THE INVENTION

The present invention provides a rear-mounted sighting aid for handguns or rifles that facilitates the ease, speed and accuracy with which a shooter aligns his weapon on a target. The present invention uses a two-tone colored, rear sight lens as the primary aiming component. The lens is held in an L-shaped lens frame, which also incorporates conventional "iron sights." The invention uses a front sight post with an embedded tritium insert that appears illuminated in low-light situations. The premise of the present invention aiming system is that the human eye can discern changes in color faster than attempting to align the sight picture using tradition three-dot or notch-and-post configurations, thus enabling the shooter to get on target faster and more accurately.

The two-tone colored lens of the present invention is unique and has two regions: an outside perimeter of one color and a central portion of another color. For exposition purposes, the perimeter will be red and the central portion green. Other color combinations may be used providing there is contrast between the two colors. In operation target acquisition is achieved when the bright front post, using a tritium insert, is aligned with the target and also appears inside the lens central green circle. If the shooter detects the front tritium sight in the lens perimeter red zone, the shooter is slightly off target and must re-align to get the correct sight picture before firing the weapon. This slight peripheral realignment is accomplished while the shooter keeps his or her eyes focused on the target/threat.

The lens frame can fold or rotate forward from an upright locked position to a locked-down position using a manually activated one-handed operation. In the locked-down position, the integral iron sights, i.e., rear notched aperture, come into play and the weapon can be sighted using the conventional rear notch or three-dot system. Thus the shooter has the option of deploying the colored aiming lens or iron sights as the situation dictates.

The lens, when deployed, presents a shooter with a sight picture comprised of a small transparent green sighting area (or other contrasting color) that is the primary focal point when aiming the weapon. The lens, itself, is comprised of a small central green sighting area superimposed on a red (or other contrasting color) "no-shoot" field. The red field signifies that the shooter is not on target when viewed through the aiming lens.

There have been a number of studies done in the past which support the premise that the human eye can detect changes in color faster than aligning geometric shapes and objects, the most prominent being the early work of John R. Stroup (1935) which demonstrates how the eye and brain process information related to colors versus words or objects, i.e., "color recognitive processes." In the "Stroop Test" a reader is presented with a page of typed words spelling out various names of colors. The fonts also are of the same color. For example, the word "red" is also in red ink. People have a natural ability to quickly read and assimilate related colors and words. However, when presented with a different scenario where the reader is given a page of words where the font color of the letters is different from the color being spelled out (for example, the word "green" in red ink), Stoop observed different results. When the reader was told to pick out the number of instances where the word "red" appeared on the page, the reader reverted to just color selection alone and not the word they were told to find. In this scenario, the reader took more time to read and process the word "red," which might appear in a different font color while other words spelling out the names of colors were in red font. This supports the hypothesis that the human eye and brain are predisposed to note changes in color faster than it can process shapes (or in this case letters). The easiest and most common association of color versus words/objects is traffic lights. Evan at a distance one can discern the inherent message, i.e., green means "Go" while red means "Stop."

Work performed by sports optometrist Dr. Hal Breedlove in 1995 demonstrated that during SNS activation a person's field of view can be reduced by as much as 70%, as well as failing to detect subtle threat movements, owing to the loss of peripheral vision (tunnel vision), and that the dominant eye (used for precision shooting, i.e., monocular vision) is lost. As stated above, during SNS the head tends to square off on the threat and causes the shooter to use both eyes wide open (binocular vision) as the dominant field of focus. Several other studies support this conclusion. Westmoreland (1989) examined 98 shooting scenarios involving non-stressed (PNS) and stressful (SNS) situations and found overwhelmingly that trained officers reverted to a squared-off stance (isosceles stance that focuses on the immediate threat) when confronted by life-threatening situations and did not focus on the gun sight. Burroughs (1997) found that when placed in potential life-threatening situations, a shooter instinctively faces or squares off to the potential threat, and the shooter loses focus for near objects (gun sights). Burroughs found that 59% of his subjects reported not actually "seeing" or using their sights under high stress (SNS) type scenarios, but focused almost exclusively on the threat/target itself. Ashton/Quinlan (1997) confirmed loss of focus on the front sight, and loss of auditory input (auditory exclusion) while under stress/SNS.

The ability to focus on close objects (like gun sights) is a function of parasympathetic nervous system (PNS), which is in control during periods of non-stress, and whereby the eyes and brain function with normal reflexive action. However, that control is immediately inhibited when SNS is activated. Guyton's Medical textbook states that during PNS, the normal body state (non-stressful), the human eye takes up to one full second to refocus from a near object to a distant object, but when SNS is activated, the human eye loses its ability to focus on near objects.

There are, therefore, several factors simultaneously in play when considering the use of the present invention: empirical studies supporting the premise of the human eye reacting faster to changes in color over alignment of notch-and-post or three-dot sighting systems, and the reactions and defense tactics humans instinctively employ when faced with life-threatening situations.

To help mitigate the SNS tendency to ignore physical gun sights and to help shooters quickly get on target, the present invention presents a field of view that allows the shooter, even under stressful conditions, to always focus directly on the target and not on the weapon's aiming points. This is accomplished by the present invention's contrasting colored lens. This helps the eye to quickly align the weapon by superimposing the lens on the target, but without actually having to shift the field of focus from the distant target to the near gun sights. When using the present invention lens in the upright position, the weapon is brought into the shooter's line of sight (hand/eye coordination), but without taking the eyes off the target (binocular vision). With the present invention two-color lens deployed, the shooter superimposes the weapon's sighting system onto the target. When the eye detects a slight change in color represented by the front post centered within the rear sight lens, the shooter knows he is on target and can fire the weapon. When aiming the weapon in this fashion, the shooter never takes his eyes off the potential threat or target. There is no need, therefore, for the eyes to re-focus from the near object (the gun sights) to the far object (the target).

These together with other objects of the invention, along with various features of novelty which characterize the invention, are pointed out with particularity in the claims annexed hereto and forming a part of the disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
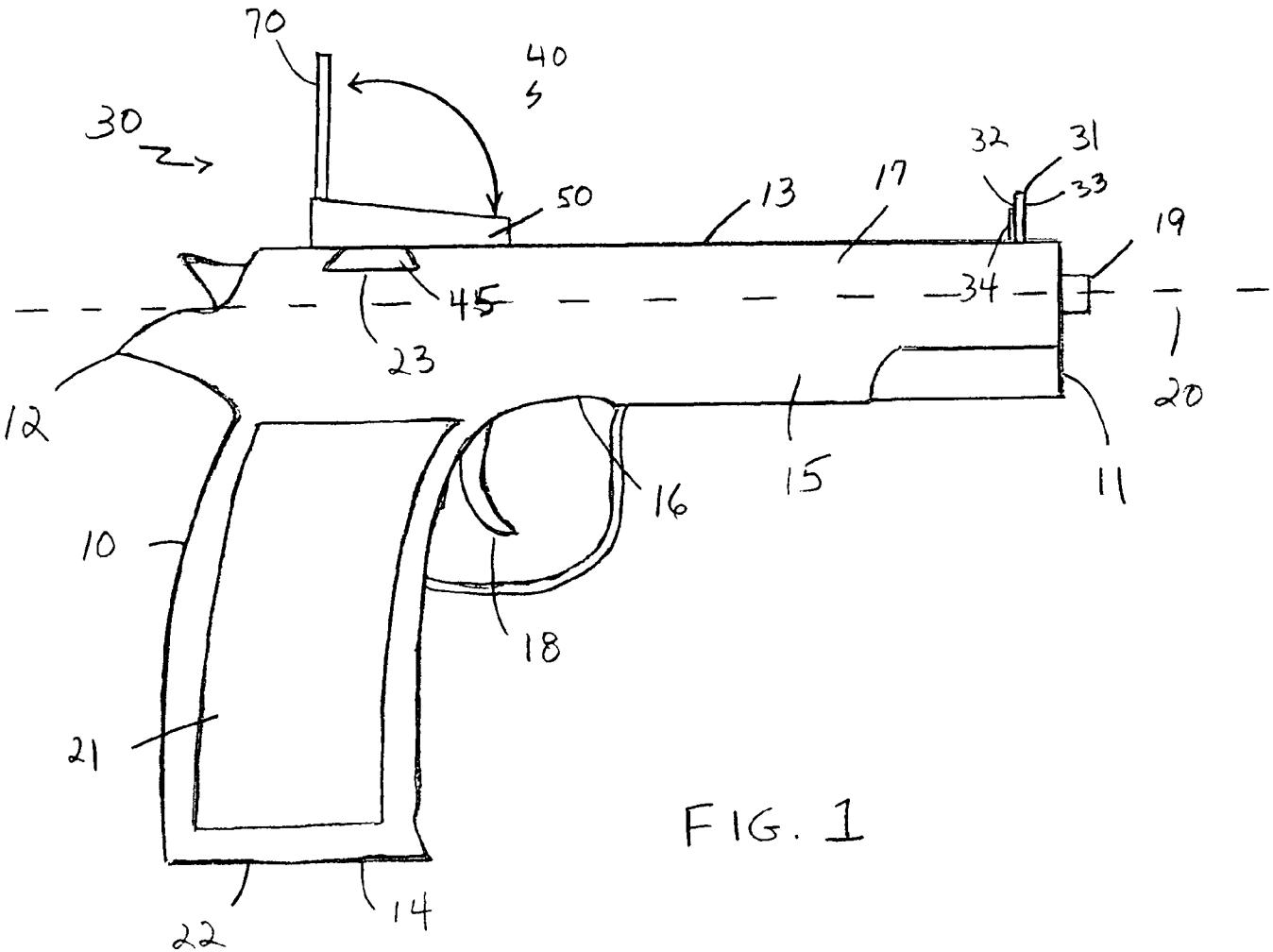
FIG. 1 is a side view of a handgun with the invention flip-up aiming sight.
Figure 2:
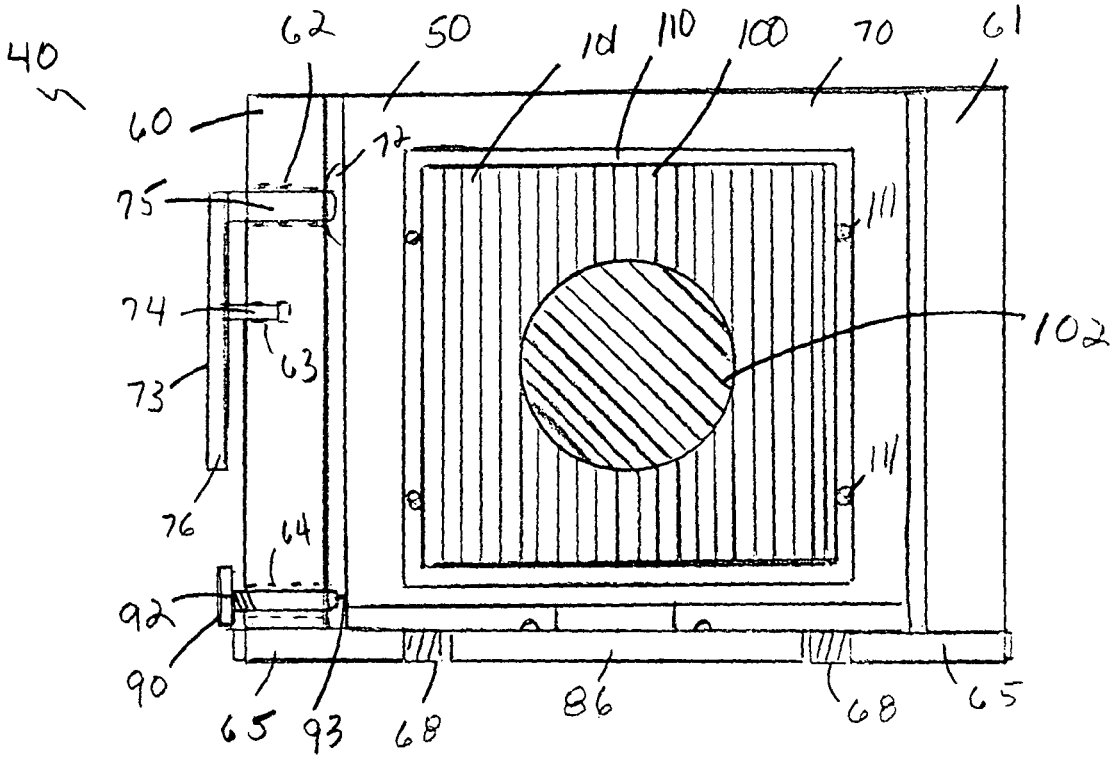
FIG. 2 is a top view of the aiming system rear sight, with lens lined for colors.
Figure 3:
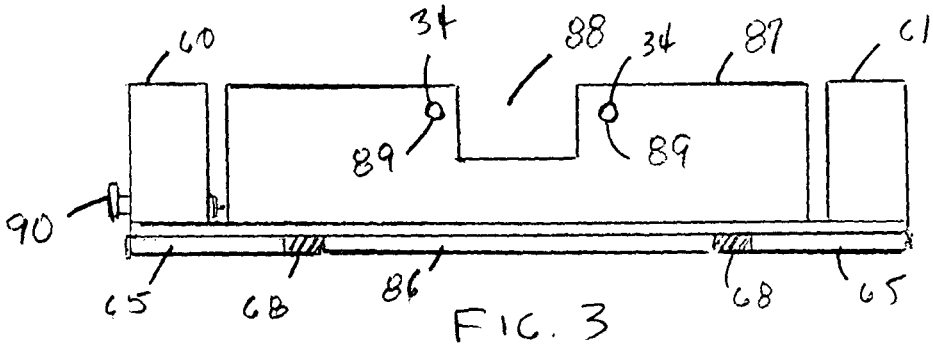
FIG. 3 is a rear view of the aiming system rear sight with the flip-up lens in a stored position.
Figure 4:
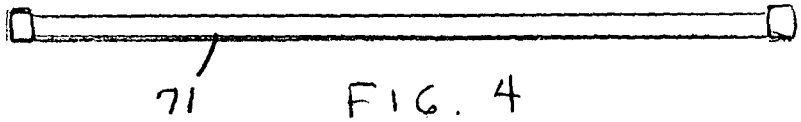
FIG. 4 is a plan view of a hinge pin.
Figure 5:
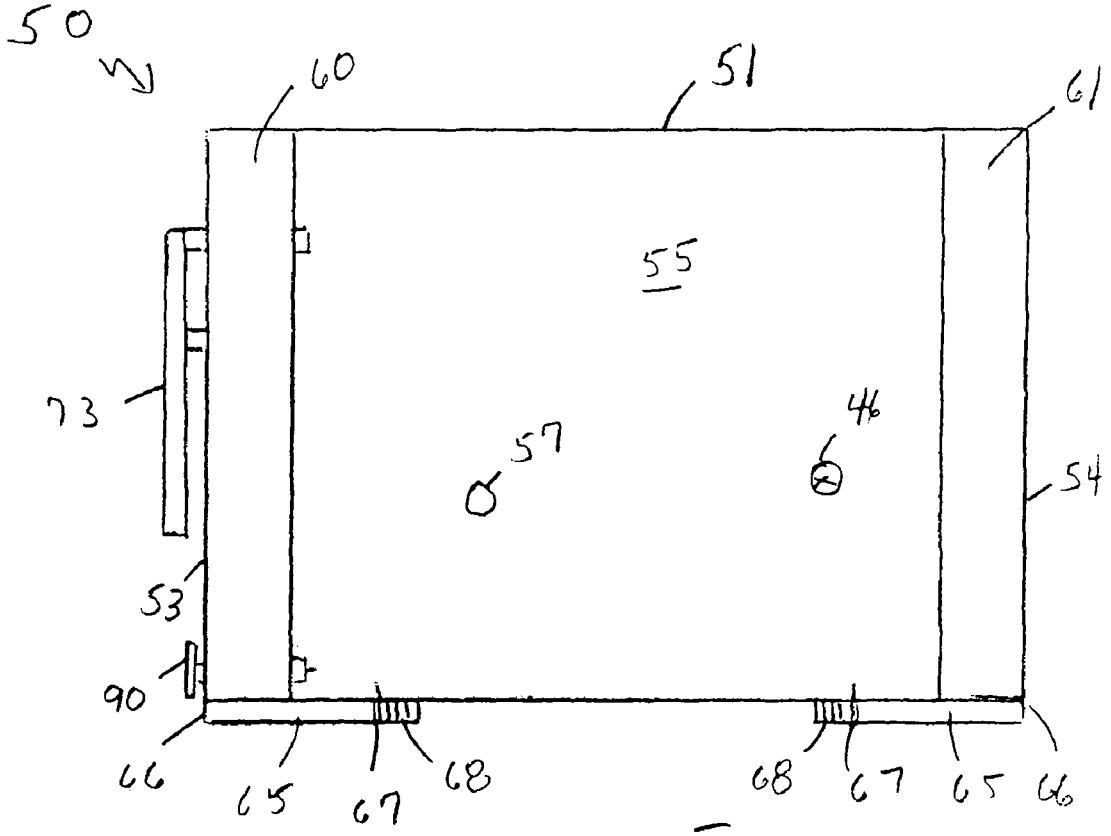
FIG. 5 is a top view of the invention rear sight base unit.
Figure 6:
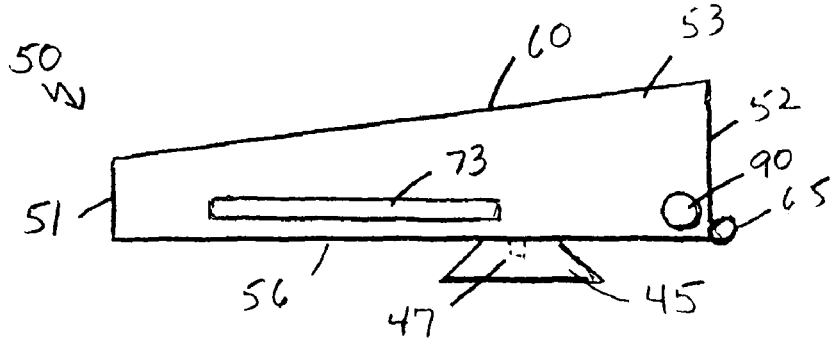
FIG. 6 is a side view of the invention rear sight base unit.
Figure 8:
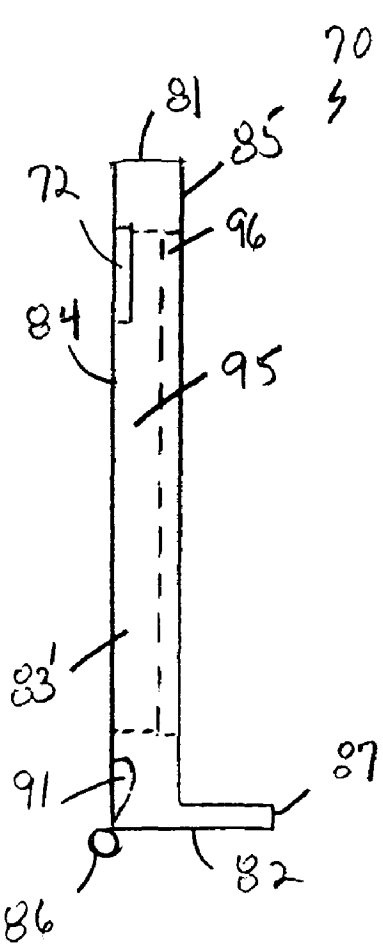
FIG. 8 is a side view of the rear sight flip-up lens.
Figure 7:
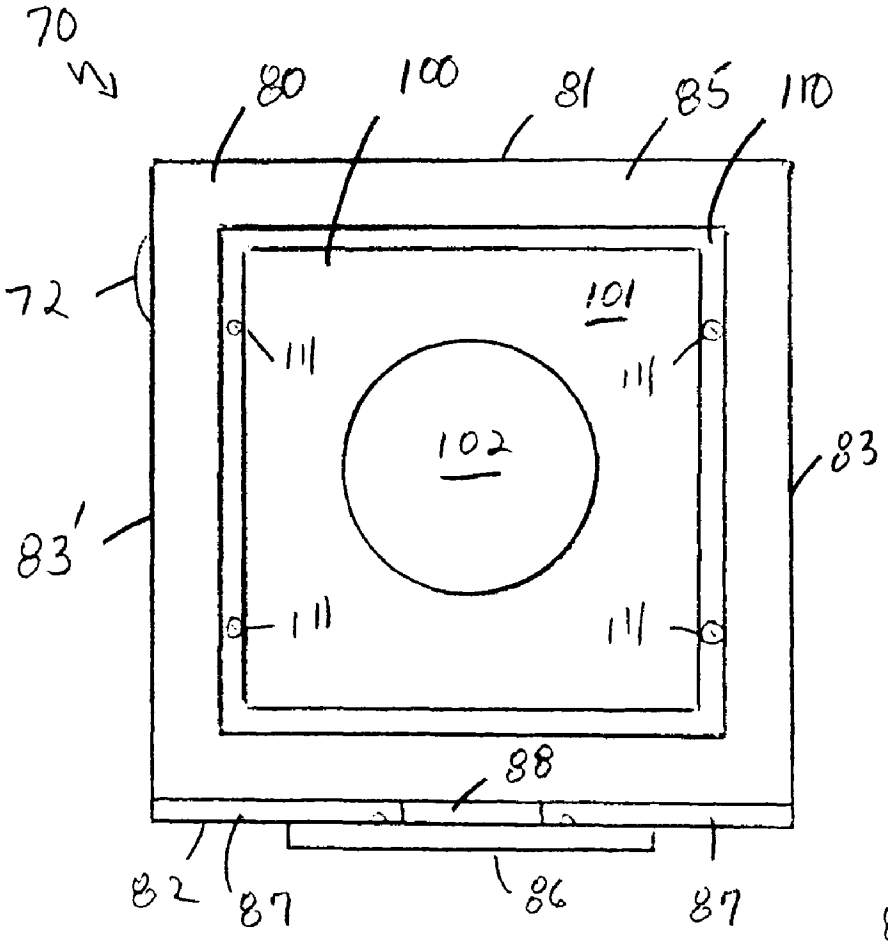
FIG. 7 is a top view of the rear sight flip-up lens.
Figure 9:
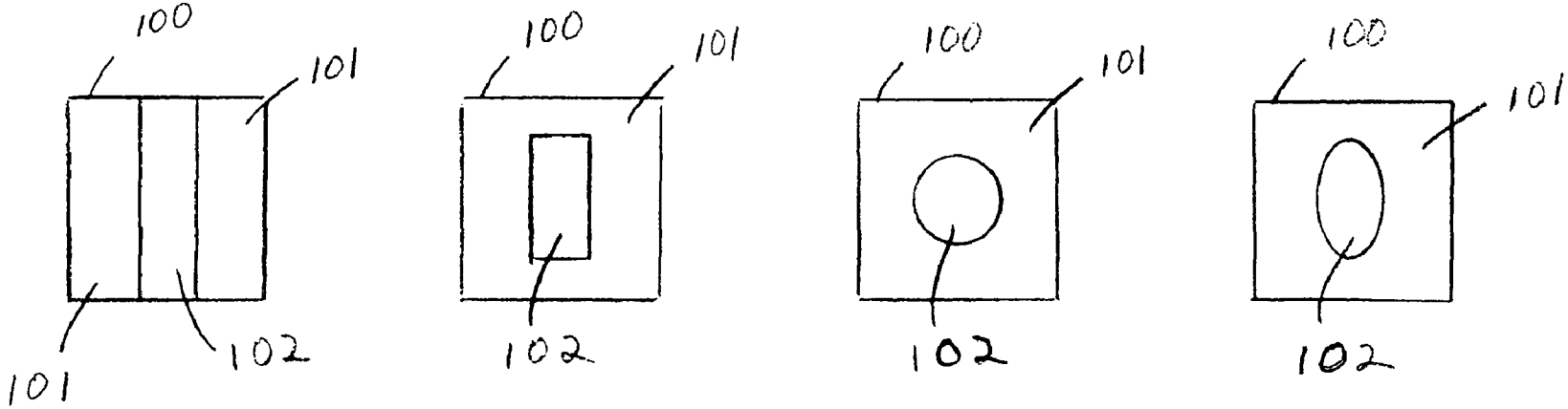
FIG. 9 is a view of various lens configurations available for use in the invention.

Referring to the drawings in detail wherein like elements are indicated by like numerals, there is shown an aiming system 30 constructed according to the principles of the invention, said aiming system 30 being mounted on a handgun 10. For purposes of exposition, the handgun shown is a conventional auto-loading, semi-automatic pistol. The handgun 10 has a front 11, rear 12, top 13, bottom 14, and two opposite lateral sides 15. The handgun 10 is further comprised of a frame 16, a slide 17 and a fire control mechanism that operates via actuation of a trigger 18. The slide 17 is that portion of the handgun that forms the top of the handgun and is displaceable on the frame 16. The slide houses a barrel 19 in the forward end thereof. The barrel 19 is cooperatively linked with the slide 17 and, together with the slide 17, defines a longitudinal firing axis 20. The handgun bottom 14 is defined by a handgrip 21 into which a magazine 22 is inserted. Upon handgun discharge, the slide 17 will travel rearward with the recoil from the discharged bullet and return again to the firing position. The aiming system 30 is incorporated onto the slide via dovetails, although grooves or mounting screws could also be used.

The aiming system 30 is comprised of a front sight 31 and a rear sight 40. The front sight 31 is a post or vertical protrusion formed on the handgun slide 17 near the handgun front 11. The rear sight 40 is mounted on the handgun slide 17 near the handgun rear 12. The front sight 31 has a rearward side 32 facing the rear sight 40 and an opposite forward side 33. The front sight rearward side 32 has a tritium insert 34. The insert 34 is a tiny glass vial of a radioactive gas. The inside of the vial is lined with a phosphor. The phosphor glows when excited by particles from the radioactive gas. Tritium inserts are commonly used as a self-powered lighting device to illuminate the front sight post in low-light conditions. The front sight post with tritium insert is also highly visible in daylight. The usual color of the tritium insert 34 is a glowing greenish color. There are, however, several other colors available commercially, including orange and yellow. The front sight post may also optionally be painted white around the tritium insert to enhance daylight visibility.

The aiming system rear sight 40 is attached to the handgun slide 17 near the handgun rear 12. The rear sight 40 comprised of a base unit 50 and a flip-up lens 70 pivotally attached to said base unit 50. The base unit 50 has a front 51, a rear 52, a left side 53, a right side 54, a top surface 55 and a bottom surface 56, said base unit front 51 and rear 52 defining a base unit longitudinal axis, said base unit longitudinal axis being parallel to the handgun longitudinal firing axis 20. The base unit 50 is further comprised of a dovetail component 45, either separately attached to or integral with the base unit bottom surface 56. The dovetail component 45 is fitted into a dovetail slot 23 machined into the handgun slide 17 near to the handgun rear 12. The dovetail component 45 can be either integral to the base plate bottom surface 56, i.e., a one-piece machined component, or a separate component that attaches to the base unit 50. If the dovetail component 45 is a separate component, it is attached to the base unit 50 via set screws 46 through several of a plurality of apertures 57 in the base unit 50 and into corresponding apertures 47 in the dovetail component 45. In either case, the dovetail component 45 fits into the handgun slide dovetail slot 23, thereby attaching the rear sight 40 to the handgun 10.

The base unit 50 has two raised side rails 60 and 61 on the base unit top surface 55, each side rail 55 adjacent a base unit side 53, 54, respectively, and extending from the base unit front 51 to the base unit rear 52. Said base unit front and rear define a longitudinal axis for each side rail. The base unit 50 is further comprised of two hollow hinge cylinders 65 attached to the base unit rear 52. Each cylinder 65 has a central axis transverse to the longitudinal axis of the base unit 50. Each cylinder 65 has two ends, an exterior end 66 and an interior end 67. Each hinge cylinder exterior end 66 terminates at a base unit side 53 or 54. Each hinge cylinder interior end 67 faces the opposite hinge cylinder interior end 67. Each hinge cylinder interior end 67 terminates in a coil spring 68.

The flip-up lens 70 is comprised of a lens frame 80 holding a lens 100. The lens frame 80 has a distal end 81, a proximal end 82, two opposite sides 83, a front surface 84 and a rear surface 85, said distal and proximal ends defining a lens frame longitudinal axis. The lens frame longitudinal distance along its longitudinal axis is less than the base unit longitudinal distance along its longitudinal axis. The lens frame 80 has a hinge cylinder 86 centrally attached to the lens frame proximal end 82. The lens frame hinge cylinder 86 is adapted to being positioned centrally between the two base unit hinge cylinders 65 and engaging the two base unit coil springs 68. The lens frame 80 is rotatably attached to the base unit 50 by means of an elongated hinge pin 71 inserted into the base unit hinge cylinders 65 and lens frame hinge cylinder 86, thereby holding the lens frame hinge cylinder 86 between the base unit hinge cylinders 65.

The lens frame side-to-side width 83-83 is less than the distance between the base unit side rails 60-61. The lens frame 80 is adapted to two positions. The first lens frame position is a pivoted ninety degrees upright from said lens platform top surface 55 along a pivot axis formed by the central axes of the two base unit hinge cylinders 65 and the lens frame hinge cylinder 86. The lens frame front 84 faces the aiming system sight front sight 31. This is termed the flip-up lens 70 operational position. The two base unit coil springs 68 urge the lens frame 80 into this position. The second lens frame position is to lay flat against the lens platform top surface 55 between the base unit side rails 60, 61. This is termed the flip-up lens stored position. The base unit side rails 60, 61 provide protection from lateral forces to the lens frame 80 while in the second position.

The lens frame rear 85 at the lens frame proximal end 82 has a ninety degree flange 87 formed therein, said flange 87 incorporating an "iron" aiming sight comprised of a notch 88 formed centrally in said flange 87. In the flip-up lens "stored" position, the flange 87 and notch 88 are positioned ninety degrees upright from the lens frame rear surface 85 at the lens platform rear 85. The notched aiming sight 88 may also have tritium inserts 34 or white dots 89 embedded on each side of the rear notch 88 to help align the aiming system 30 in low light conditions.

The lens frame left side 83' has a tab 72 formed therein, near to the lens frame distal end 81. The tab 72 protrudes laterally away from the lens frame left side 83'. The base unit left side rail 60 has three apertures, i.e., a first aperture 62, a second aperture 63 and a third aperture 64, formed therein along the left side rail longitudinal axis. The left side rail first aperture 62 extends through the left side rail width and corresponds to the lens frame tab 72 when the lens frame is in a stored position. The left side rail second aperture 63 is positioned rearward of the left side rail first aperture 62 and extends partly through the side rail. A lock-down lever 73 is inserted into the left side rail first and second apertures 62, 63. The lock-down lever 73 is comprised of a pivot element 74 inserted into the second aperture 63. The lock-down lever 73 is further comprised of an action element 75 attached to said pivot element 74 and extending into and partly through the first aperture 62. The lock-down lever 73 is further comprised of a control element 76 attached to said pivot element 74 and extending rearward parallel to said left side rail longitudinal axis. The lock-down lever action element 75 is adapted to engage the lens frame tab 72 thereby preventing the lens frame from moving from its stored position to an operational position. By pressing the lock-down lever control element toward the left side rail 60, the action element 76 is pivoted about said pivot element away from the lens frame tab 72 thereby allowing the base unit coil springs 68 to bring the lens frame 80 into the operational position.

The left side rail third aperture 64 is positioned near to the base unit rear 52 and is adapted to receive a plunger 90. The lens frame 80 has a curved notch 91 formed in the lens frame left side 83' extending from the lens frame front 84 to the lens frame proximal end 82. The plunger 90 is spring-loaded and extends through the left side third rail aperture 64 into the lens frame left side curved notch 91 when the lens frame is in an operational position. The plunger spring 92 urges the plunger into the notch 91. To fold the lens frame down into its folded position, the plunger 90 is pulled out of the notch 91 and the lens frame folded down to the base unit top surface 55. The plunger 90 is then released and the plunger tip 93 is brought into contact with the lens frame left side 83', outside of the notch 91.

The lens frame 80 is machined to accept a thin, two-toned, tinted, transparent lens 100. The lens 100 is preferably comprised of a polycarbonate material, which is shock and shatter proof to withstand recoil when the handgun is fired. The lens frame 80 has a central, rectangular aperture 95 which may be may be grooved or beveled along the central aperture four sides, thereby forming a lens frame rear surface recessed area 96 about the lens frame central aperture 95. The lens 100 is fitted into the recessed area 96. A lens retention plate 110 with the dimensions of the lens frame recessed area 96 is fitted over the lens 100. A plurality of set screws 111 are inserted through the lens retention plate 110 into the lens frame 80 to snugly hold the lens 100 in place.

The two-tone colored lens 100 of the present invention is unique and has two regions: an outside perimeter 101 of one color and a central portion 102 of another color. The lens 100 may be of several contrasting color configurations thus giving the shooter the option of switching lens under various shooting conditions. The contrasting colors can be any suitable combination that helps the shooter distinguish between the shoot 102/no shoot 101 zones. The lens central portion 102 may have various geometries, i.e., circular, rectangular, oval, and the like.

In operation, the handgun 10 would be typically holstered with the lens frame 80 in the second position, i.e., folded and locked down onto the base unit 50. When needed, the handgun 10 would be drawn from a holster (not shown). The shooter than actuates the lock down lever control element 76, releasing the lock down lever action element 75 from the lens frame tab 72. The hinge coil springs 68 then urges the lens frame 80 upright to the operation position. The handgun 10 would be raised to eye-level to aim on target. The shooter would super-impose the aiming system, especially the two-tone lens 100, on target so that the lens central portion 102 and front sight 31 are aligned on target, all the while keeping the eyes focused on the target, not on the weapon's aiming system 30. When the eye detects the front sight 31 in the rear sight lens central portion 102 and the shooter still has the target sighted via normal eye sight, the handgun 10 is on target and ready to be engaged.

It is understood that the above-described embodiment is merely illustrative of the application. Other embodiments may be readily devised by those skilled in the art, which will embody the principles of the invention and fall within the spirit and scope thereof.

I claim:

1. An aiming system mounted on a handgun having a front, rear, top, bottom, and two lateral sides, said handgun having a frame, a slide and a fire control mechanism actuated by a trigger, said slide displaceable on said frame and forming the handgun top, said slide housing a barrel in a slide forward end, said barrel cooperatively linked with the slide and, together with the slide, defining a longitudinal firing axis, said aiming system incorporated onto the slide and comprising:

a front sight vertically protruding from said slide near the handgun front; and a rear sight mounted on the handgun slide near the handgun rear, said rear sight comprising:

a base unit having a front, a rear, a left side, a right side, a top surface and a bottom surface, said base unit front and rear defining a base unit longitudinal axis, said base unit longitudinal axis being parallel to the handgun longitudinal firing axis;

a flip-up lens pivotally attached to said base unit, comprising:

an aiming lens having a perimeter portion of one color and a central portion of another color, said central portion having a geometry selected from the group consisting of: circle, polygon, oval, and cone; and a lens frame holding said aiming lens, said lens frame having distal end, a proximal end, a left side, a right side, a front surface and a rear surface, said lens frame distal and proximal ends defining a lens frame longitudinal axis, said lens frame longitudinal distance along its longitudinal axis being less than the base unit longitudinal distance along its longitudinal axis.

2. The aiming system recited in claim 1, further comprising:

two hollow hinge cylinders attached to the base unit rear, each said base unit hinge cylinder having a central axis transverse to the longitudinal axis of the base unit, each base unit hinge cylinder having two ends, an exterior end and an interior end, each said base unit hinge cylinder exterior end terminating as a base unit side, each said base unit hinge cylinder interior end facing the opposite base unit hinge cylinder interior end, each said base unit hinge cylinder interior end terminating in a coil spring;

a hollow hinge cylinder centrally attached to the lens frame proximal end, said lens frame hinge cylinder positionable between said base unit hinge cylinders and engaging the two base unit coil springs; and an elongated hinge pin inserted into and through said base unit hinge cylinders and said lens frame hinge cylinder.

3. The aiming system recited in claim 2, wherein:

the lens frame rear surface at the lens frame proximal end has a ninety degree flange formed therein, said flange having a notch formed centrally therein.

4. The aiming system as recited in claim 3, wherein:

the base unit has a left and right raised side rail on the base unit top, each side rail adjacent a base unit side, respectively, and extending from the base unit front to the base unit rear, said base unit front and rear defining a longitudinal axis for each side rail; and the lens frame has a side-to-side width less than a distance between said base unit side rails.

5. The aiming system as recited in claim 4, further comprising:

a tab formed on the lens frame left side near to the lens frame distal end, said tab protruding laterally away from the lens frame left side;

a first and a second aperture in the base unit left side rail, said left side first aperture extending through the left side rail and corresponding to the lens frame tab, said left side second aperture positioned rearward of the left side first aperture and extending partly through said left side rail;

a lock-down lever inserted into the left side rail first and second apertures comprising:

a pivot element inserted into the left side rail second aperture;

an action element attached to said pivot element and extending into and partly through the left side rail first aperture, said action element adapted to engage the lens frame tab;

a control element attached to said pivot element and extending rearward parallel to said left side rail longitudinal axis, engagement of said control element adapted to pivot about said pivot element disengaging the action element away from the lens frame tab.

6. The aiming system as recited in claim 5, further comprising:

a third aperture in the base unit left side rail positioned near to the base unit rear;

a curved notch in the lens frame left side extending from the lens frame front surface to the lens frame proximal end; and a spring-loaded plunger extending through the left side rail third aperture into the lens frame left side curved notch.

7. The aiming system as recited in claim 6, wherein:

the lens frame has a central aperture adapted to hold said aiming lens.

8. The aiming system as recited in claim 7, wherein:

the front sight has a rearward side facing the rear sight and an opposite forward side, said front sight rearward side has a tritium insert.

9. The aiming system as recited in claim 8, wherein:

the lens frame flange notch has a tritium insert embedded on each side.

10. The aiming system as recited in claim 9, wherein:

the front sight is painted white around the tritium insert.

* * * * *